US006312285B1

(12) United States Patent
Berg et al.

(10) Patent No.: US 6,312,285 B1
(45) **Date of Patent: *Nov. 6, 2001**

(54) PANEL MOUNTING SYSTEM FOR ELECTRICAL CONNECTORS

(75) Inventors: Paul Christopher Berg, Batavia; Joseph D. Comerci, Elmhurst; Gary E. Polgar, Bolingbrook; Julie Beyers Rutter, Batavia, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/257,623

(22) Filed: Feb. 25, 1999

(51) Int. Cl.[7] ..... H01R 13/73
(52) U.S. Cl. ..... 439/545
(58) Field of Search ..... 174/48, 50, 58; 220/3.2, 4.02, 3.8; 200/295, 296; 439/600, 607, 60, 545

(56) References Cited

U.S. PATENT DOCUMENTS

| | | | | |
|---|---|---|---|---|
| 3,995,947 | | 12/1976 | Lightner et al. | 339/92 |
| 4,040,699 | * | 8/1977 | Rasmussen | 439/91 R |
| 4,352,538 | | 10/1982 | Fowler | 339/126 |
| 4,647,129 | | 3/1987 | Kandybowski et al. | 339/64 |
| 4,921,435 | | 5/1990 | Kane et al. | 439/248 |
| 5,127,852 | | 7/1992 | Cravens et al. | 439/545 |
| 5,197,896 | | 3/1993 | Landis et al. | 439/247 |
| 5,338,226 | | 8/1994 | Bryce et al. | 439/571 |
| 5,407,363 | | 4/1995 | Polgar et al. | 439/546 |
| 5,772,469 | | 6/1998 | Polgar et al. | 439/546 |
| 5,800,208 | | 9/1998 | Ishizuka et al. | 439/557 |
| 6,030,242 | * | 2/2000 | Cunningham et al. | 439/247 |
| 6,095,854 | * | 8/2000 | Sommer et al. | 439/545 |

FOREIGN PATENT DOCUMENTS

| | | | |
|---|---|---|---|
| 0 797 274 A2 | 9/1997 | (EP) | H01R/13/631 |
| 0 805 525 A2 | 11/1997 | (EP) | H01R/13/74 |
| 0 797 274 A3 | 9/1998 | (EP) | H01R/13/74 |
| 0 805 52 A3 | 9/1998 | (EP) | H01R/13/74 |
| 7245151 | 9/1995 | (JP) . | |

* cited by examiner

*Primary Examiner*—Paula Bradley
*Assistant Examiner*—James Harvey
(74) *Attorney, Agent, or Firm*—Stacey E. Caldwell

(57) ABSTRACT

A system is provided for mounting an electrical connector in a panel having an opening with at least one locating slot in the opening. A connector includes a housing insertable into the opening in the panel. The housing has at least one outwardly projecting locating flange for passing through the locating slot of the opening as the housing is inserted thereinto. The housing has at least one outwardly projecting stop flange spaced axially and transversely from the locating flange for abutting the panel when the housing is in its inserted position. The housing is movable within the opening in the panel to a latched position. A latch arm projects outwardly from the housing on the same side thereof as the locating flange and the stop flange for engagement with a latch slot at the opening in the panel when the housing is in its latched position.

25 Claims, 7 Drawing Sheets

FIG. 9
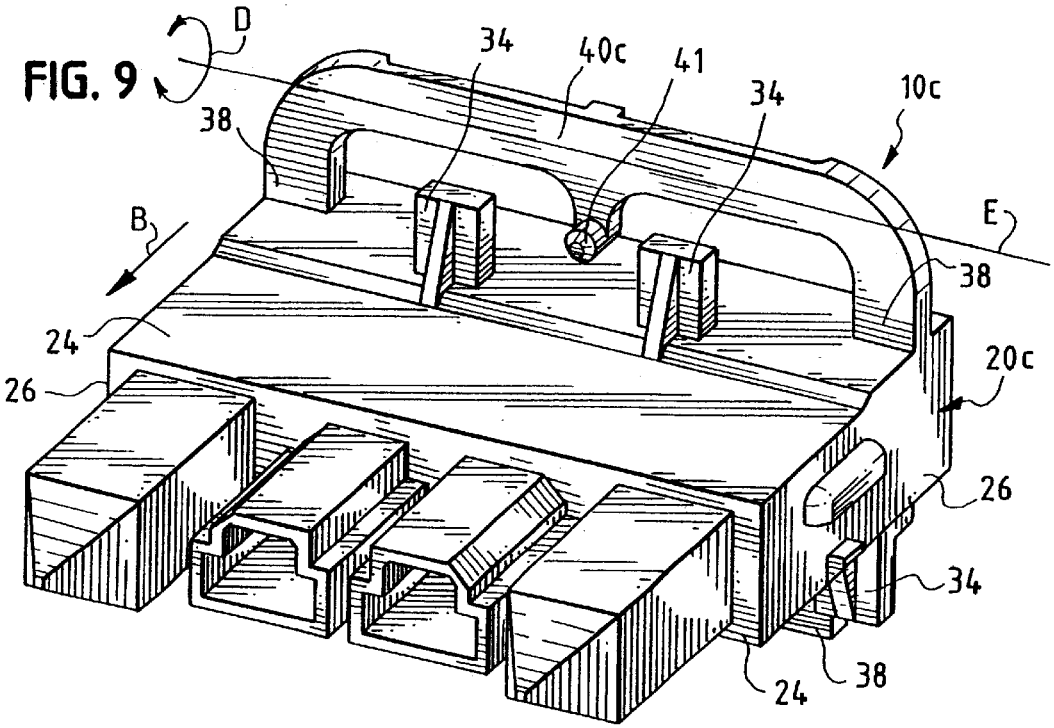
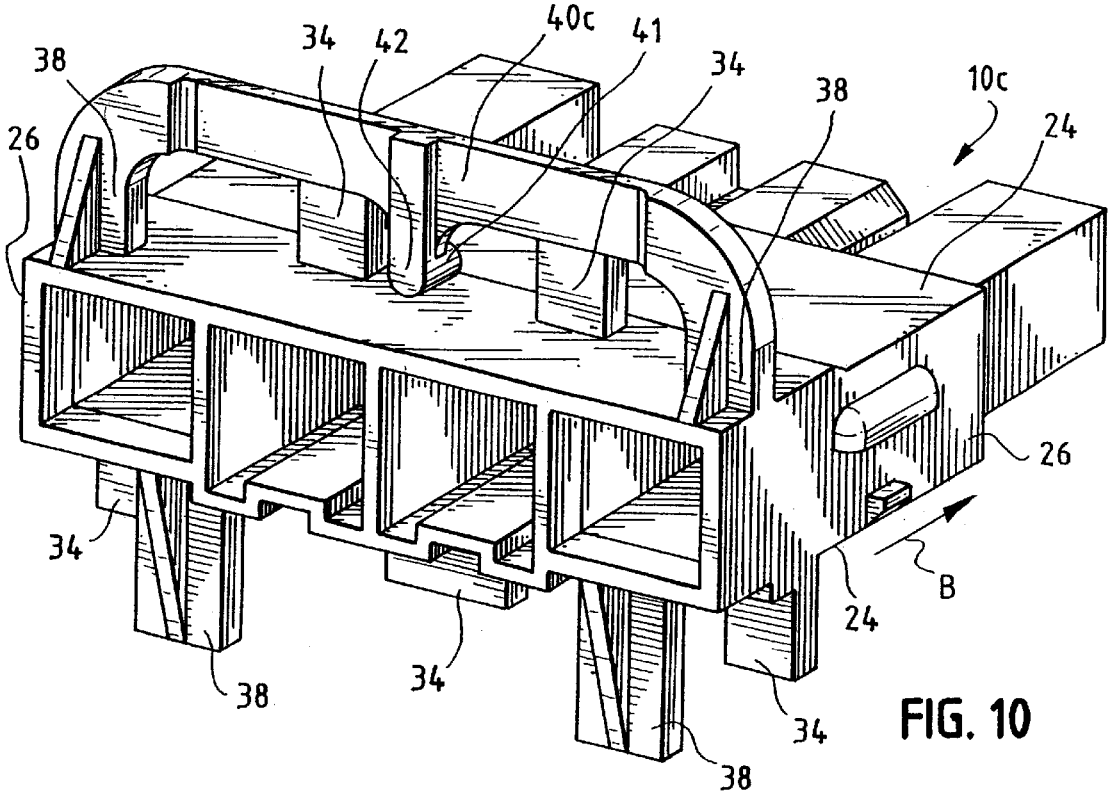
FIG. 10

PANEL MOUNTING SYSTEM FOR ELECTRICAL CONNECTORS

FIELD OF THE INVENTION

This invention generally relates to the art of electrical connectors and, particularly, to a system for mounting an electrical connector in an opening in a panel or other planar substrate.

BACKGROUND OF THE INVENTION

Panel mounted electrical connectors are known in the art, and such a connector generally includes a housing mounting a plurality of terminals for mating with a complementary connector. The housing may be mounted to a generally rigid panel for mating of the connector with the complementary connector through an opening in the panel, or the housing may be mounted on the panel simply for structural or support purposes within a circuit interconnection system.

Various means have been used to mount the connector to a panel, such as mounting clips or brackets operatively associated between the connector housing and the panel to mount and hold the connector to the panel. In other systems, the connector housing is inserted into the opening in the panel to an insertion position and then moved relative to the panel, within the opening, to a final mounted position whereat the connector is latched by latch means directly on the connector housing.

One of the problems with panel mounted connectors of the character described above is that separate latch means for holding the connector in the opening in the panel takes up valuable "real estate" on the panel and weakens the structure. In other words, if it is desirable to mount the connector close to another connector or any other structure, the latch means often requires the connector to be unnecessarily spaced from any surrounding component with a weakened panel. For instance, the latch means may include extraneous "outboard" latch openings in the panel. Engaging flanges or lugs often are used on one or more sides of the connector housing to hold the housing in the panel openings, and latches often project from still other sides of the connector housing to unnecessarily enlarge the connector envelope.

The present invention is directed to solving the problems discussed above in a panel mounting system for an electrical connector, and particularly in the latch means for holding the connector in its final mounted position.

SUMMARY OF THE INVENTION

An object, therefore, of the invention is to provide a new and improved system for mounting an electrical connector in a panel or other planar substrate.

In the exemplary embodiment of the invention, a panel has first and second sides and an opening, with at least one locating slot extending radially from the opening. A connector has a housing insertable from the first side of the panel along an axis to an insertion position into the opening in the panel. The housing includes at least one radially extending locating flange at one side of the housing for passing through the locating slot of the opening as the housing is inserted thereinto. The housing also includes at least one radially extending stop flange spaced axially and transversely from the locating flange for abutting the first side of the panel when the locating flange clears the second side of the panel. The housing is movable generally parallel to the panel from the insertion position to a latched position.

A latch arm projects from the one side of the connector housing and is engageable with a latch slot extending radially from the opening in the panel when the housing is in the latched position.

As disclosed herein, the locating slot performs a dual function and comprises the latch slot for the latch arm. In one embodiment of the invention, the latch arm comprises a flexible cantilevered latch arm extending generally parallel to the axis of insertion of the connector housing. In a second embodiment of the invention, the latch arm comprises a flexible cantilevered latch arm extending generally parallel to the panel.

Preferably, at least one locating flange and at least one stop flange are disposed on each of two opposite sides of the connector housing. As disclosed herein, a plurality of the locating flanges and a plurality of the stop flanges are disposed on each of the two opposite sides of the connector housing, with the locating flanges passing through a plurality of locating slots in the opening in the panel. In a third embodiment of the invention, the latch arm comprises a flexible latch bar extending between a pair of the stop flanges. The latch bar includes a tab supporting a projection, and the latch bar torsionally moves to urge the projection into engagement with the latch slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 9 is a perspective view of a connector according to a third embodiment of the invention;

FIG. 10 is a perspective view looking toward the rear of the connector as viewed in FIG. 9;

DETAILED DESCRIPTION OF THE PREFERRED EMBODIMENTS

Figure 1:
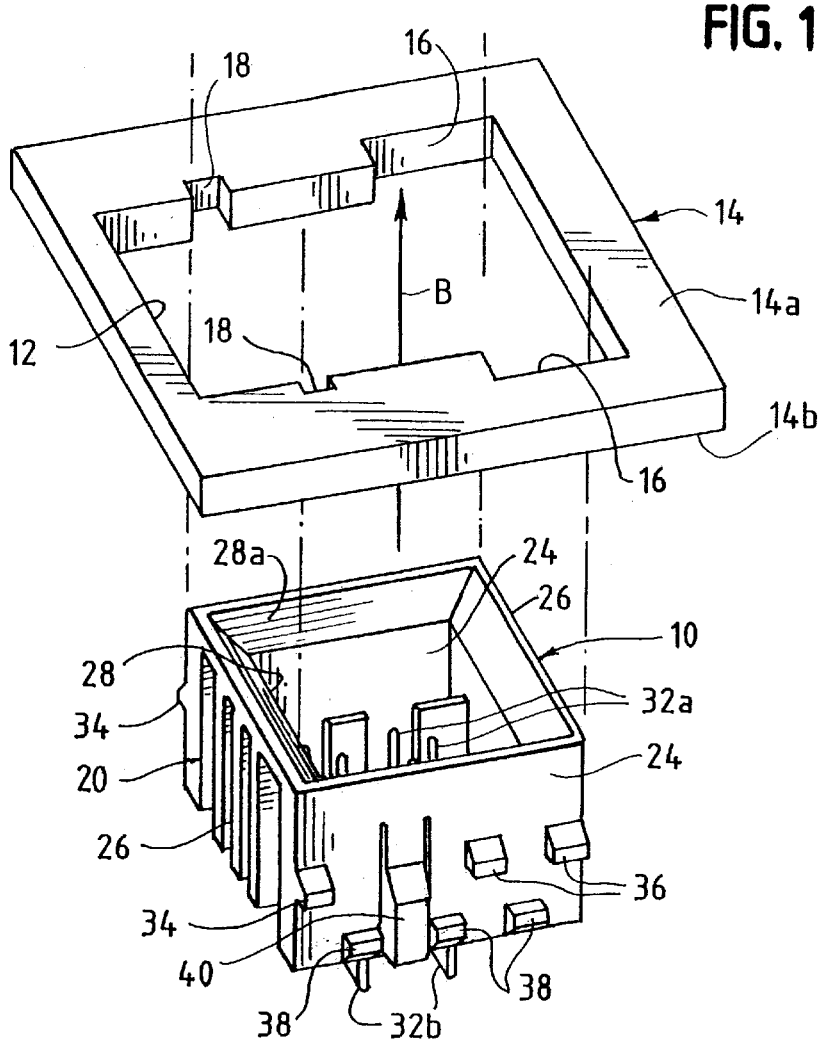
FIG. 1 is an exploded perspective view of a panel with an opening therein, along with an electrical connector insertable into the opening, according to a first embodiment of the invention.

Referring to the drawings in greater detail, and first to FIG. 1, a first embodiment of the invention herein is directed to a system for mounting an electrical connector, generally designated 10, in an opening 12 in a panel, generally designated 14. The panel has a top side 14*a* and a bottom side 14*b*. The opening is generally T-shaped to define a pair of elongated locating slots 16 at opposite ends of the cross portion of the T-shaped configuration. A pair of additional locating slots 18 are located at each opposite side of the leg portion of the T-shaped configuration of the slot, intermediate the ends thereof.

Connector 10 includes a one-piece housing, generally designated 20, unitarily molded of dielectric material such as plastic or the like. The housing is box-shaped to define a pair of first opposite side walls 24 and a pair of second side walls 26 which define a rectangular receptacle 28 for receiving a complementary mating connector. The mouth of receptacle 28 is chamfered, as at 28*a*, to facilitate inserting a mating connector thereinto. The housing has a bottom wall 30 (FIG. 4) which mounts a plurality of terminals, generally designated 32. The terminals have contact pins 32*a* projecting into receptacle 28 for engaging the terminals of the mating connector. The terminals have tail portions 32*b* projecting from bottom wall 30 exteriorly of the housing for insertion into appropriate holes in a printed circuit board or into another connecting device. Of course, the invention herein is not limited to a board-mounted connector.

Figure 2:
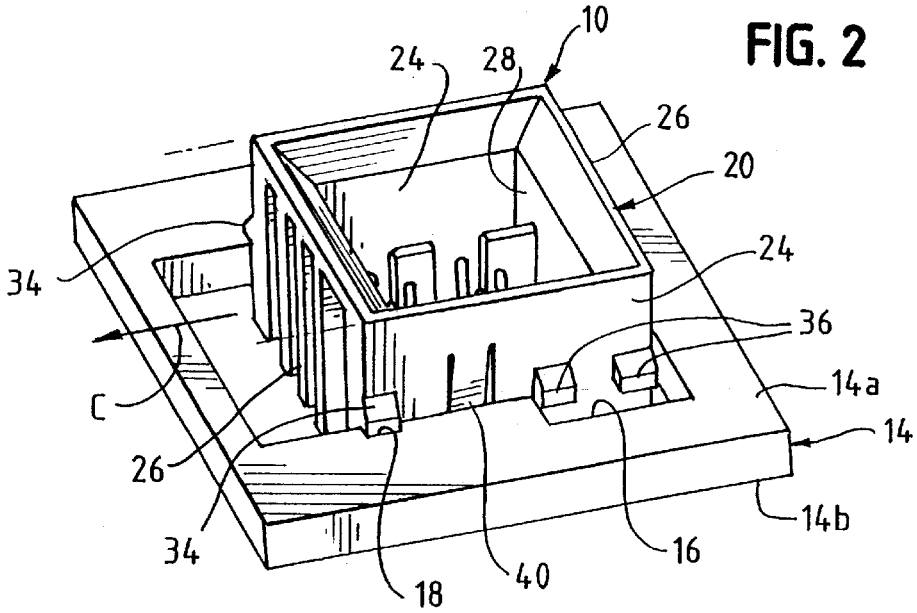
FIG. 2 is a perspective view of the connector inserted into the opening in the panel to its insertion position.
Figure 3:
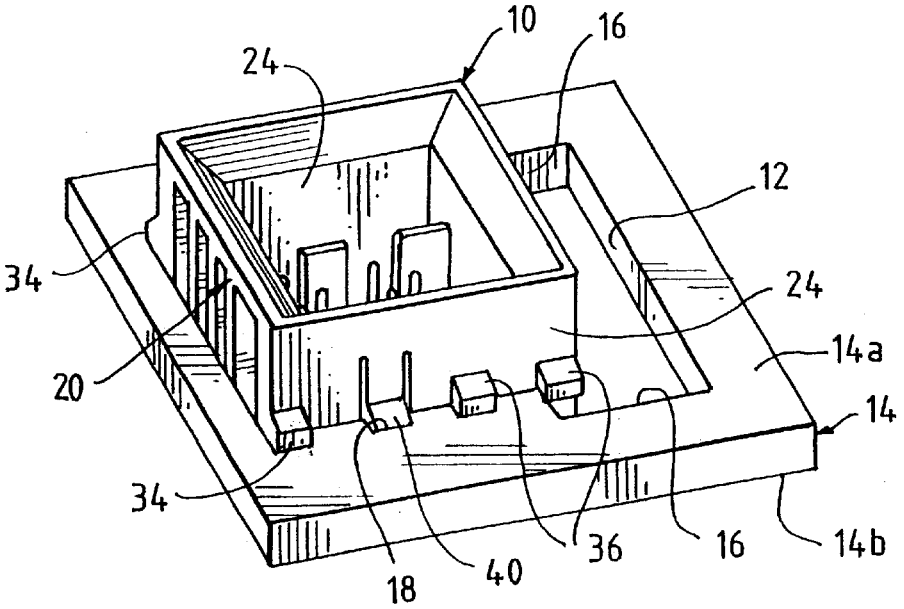
FIG. 3 is a perspective view of the connector moved from its insertion position to its final latched position.

All of the mounting and latching components on connector housing 20 are located on the outsides of first side walls 24, as seen by the outside of the one side wall 24 visible in FIGS. 1–3. That leaves the outsides of second side walls 26 totally unencumbered and allows the connector to be mounted closely to other components.

More particularly, three locating flanges 34 and 36 project outwardly from each side wall 24. The tops of the locating flanges are chamfered to facilitate inserting the connector housing into the opening in the panel. The bottoms of the located flanges are abrupt for abutting against top surface 14*a* of panel 14 when the connector is in its final latched position, as described hereinafter. Three stop flanges 38 also project outwardly from the outside of each side wall 24 for abutting bottom side 14*b* of the panel when the connector is in its final latched position. The stop flanges are spaced axially and transversely of locating flanges 34 and 36. The locating flanges and the stop flanges are molded integrally with the housing.

Figure 4:
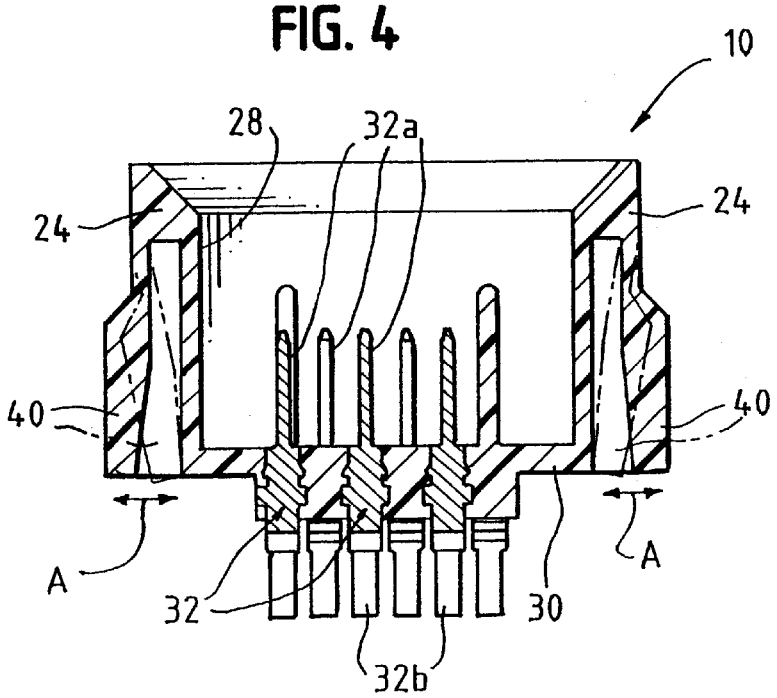
FIG. 4 is a vertical section through the connector in the area of the latch arms thereof.
Figure 5:
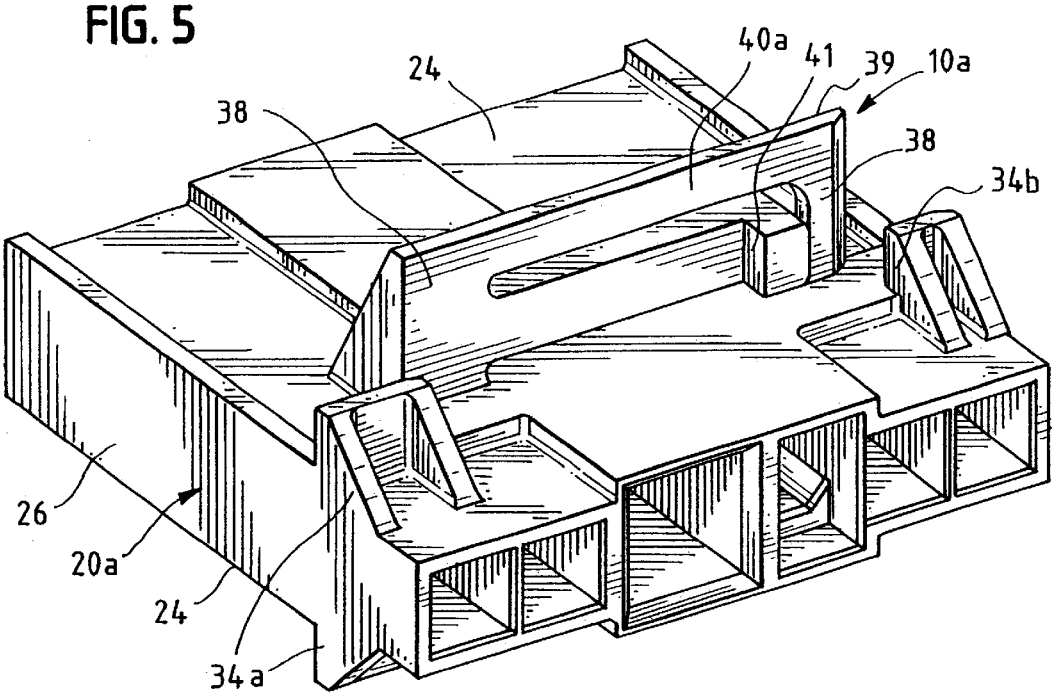
FIG. 5 is a perspective view of a connector according to a second embodiment of the invention.
Figure 6:
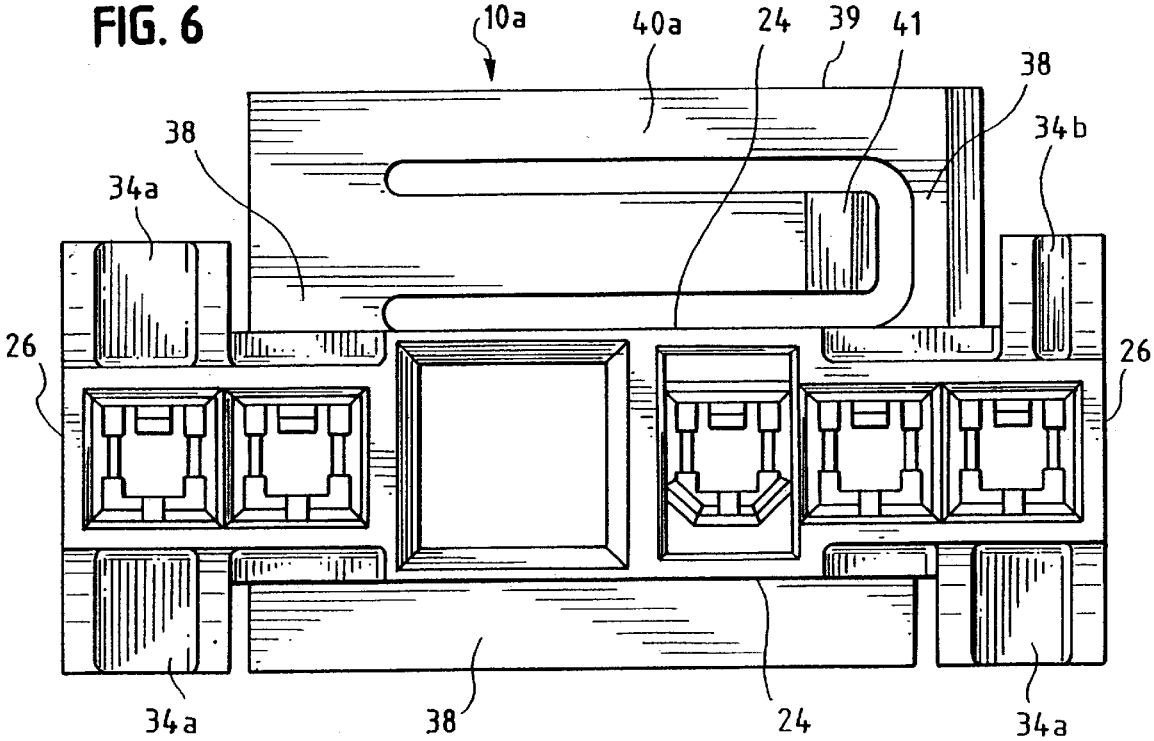
FIG. 6 is a front elevational view of the connector of FIG. 5.

Referring to FIG. 4 in conjunction with FIG. 1, an integrally molded latch arm 40 also projects outwardly from the outside of each side wall 24. As best seen in FIG. 4, each latch arm is cantilevered from its respective side wall so that the latch arm can flex in the direction of double-headed arrows "A" (FIG. 4). The cantilevered latch arms extend in the insertion direction of the connector as will be apparent hereinafter. Like locating flanges 34 and 36, the tops of the latch arms are chamfered.

The operation of the panel mounting system of the invention now will be described. Connector 10 is inserted into opening 12 in panel 14 in a first linear direction from the bottom side of the panel along an axis in the direction of arrow "B" (FIG. 1). Locating flanges 34 and 36 and stop flanges 38 extend outwardly of the housing radially of this direction. As the connector is inserted into the opening, locating flanges 34 pass through locating slots 18, and locating flanges 36 pass through locating slots 16 until all of the locating flanges clear the top side 14*a* of the panel. As at this point, at least the two stop flanges 38 on opposite sides of latch arms 18 abut bottom side 14*b* of the panel to define the inserted position of the connector as seen in FIG. 2. In this inserted position, latch arms 40 are resiliently flexed inwardly by engagement with the edges of opening 12 between locating slots 16 and 18.

Once connector 10 is inserted to its insertion position shown in FIG. 2, the connector is moved in a second linear direction as indicated by arrow "C" (FIG. 2) generally perpendicular to the insertion direction "B" until the connector reaches its final latched position shown in FIG. 3. In the latched position, latch arms 40 become aligned with locating slots 18, and the flexible latch arms "snap" back outwardly into the locating slots to lock the connector in its final latched position. In this final position, locating flanges 34 and 36 abut top side 14*a* of panel 14 and stop flanges 38 abut bottom side 14*b* of the panel. Therefore, the locating flanges and stop flanges lock the connector axially within the opening in the panel, and latch arms 40 lock the connector radially within the opening.

FIGS. 5–8 show a second embodiment of an electrical connector, generally designated 10*a*, embodying the concepts of the invention. Like reference numerals have been applied in FIGS. 5–8 corresponding to like components described above regarding connector 10 in FIGS. 1–4.

With that understanding, connector 10*a* includes a one-piece housing, generally designated 20*a*, having a pair of opposite side walls 24. Locating flanges 34*a*, 34*b* project from opposite side walls 24. Stop flanges 38 also project from the two side walls 24. As with the first embodiment, the stop flanges are spaced axially and transversely from the locating flanges. An integrally molded latch arm 40*a* also is disposed at one of the side walls. The latch arm is cantilevered from one of the stop flanges 38 and includes a latch projection 41 at its distal end. Latch arm 40*a* extends generally parallel to the panel and generally perpendicular to the insertion direction of the connector into the panel. Protector bar 39 is attached to stop flanges 38 and extends parallel to the latch arm 40*a*. The protector bar 39 helps to prevent the latch projection 41 from being removed from the locating slot 16 and protects the latch arm 40*a* from breakage.

Figure 7:
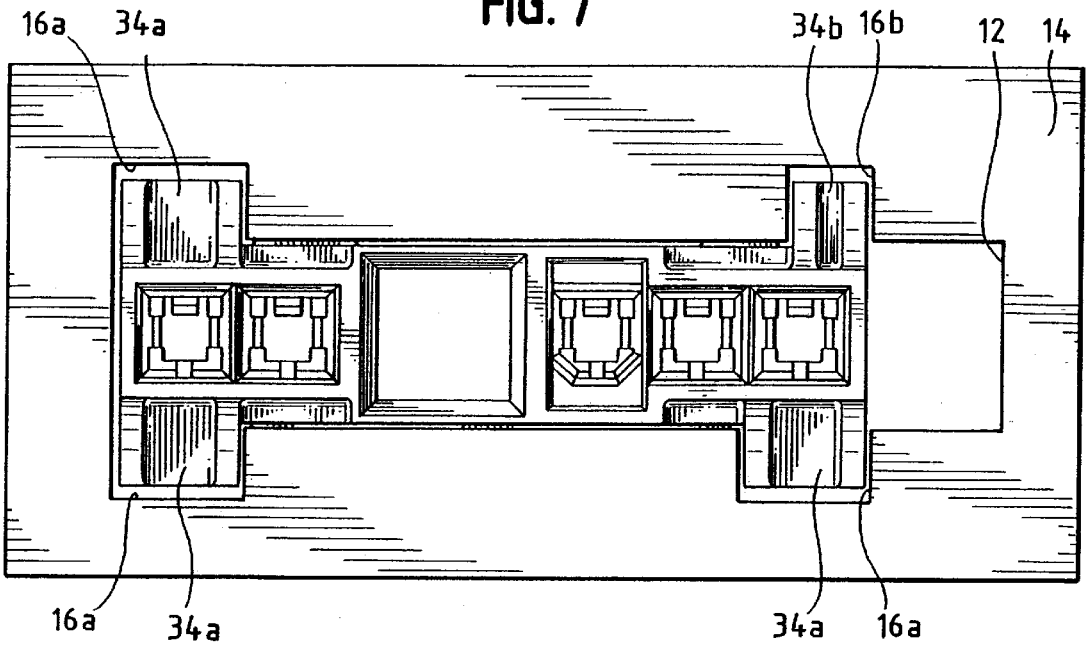
FIG. 7 is a plan view of the connector of FIGS. 5 and 6 inserted into an opening in a panel to its insertion position.

FIG. 7 shows connector 10*a* inserted into an opening 12 in a panel 14. The opening is elongated and has a pair of radially extending locating slots 16*a*, 16*b* through which locating flanges 34*a*, 34*b* of connector 10*a* are inserted to an insertion position shown in FIG. 7. At least one locating flange 34*b* is smaller than the other locating flanges 34*a* to provide polarization protection in the panel which has at least one locating slot 16*b* smaller than the other locating slots 16*a*. In the insertion position, stop flanges 38 and protector bar 39 (FIG. 6) abut the opposite side of panel 14 from the side visible in FIG. 7. Latch projection 41 will abut the opposite side of the panel and cause latch arm 40*a* to flex or become "cocked".

Figure 8:
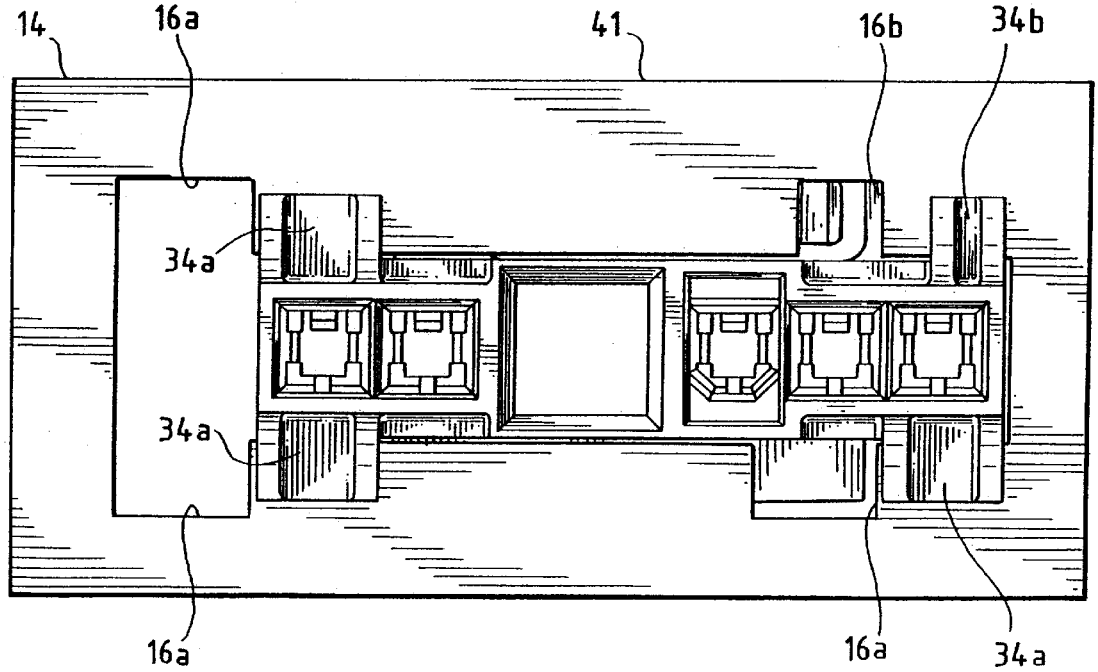
FIG. 8 is a view similar to that of FIG. 7, with the connector moved from its insertion position to its final latched position.

Connector 10*a* is moved from its inserted position of FIG. 7 to its final latched position shown in FIG. 8. In this position, panel 14 is sandwiched between locating flanges 34*a*, 34*b* and stop flanges 38. In this final latched position, latch projection 41 will snap into one of the locating slots 16*b* as seen in FIG. 8, under the energy stored within flexed latch arm 40*a*. By designing the latch projection 41 to snap into an existing locating slot 16*b*, the locating slots 16*a*, 16*b* can be used to allow the locating flanges 34*a*, 34*b* to pass through the panel 14 in addition to allowing the latch projection 41 to snap into said locating slot 16*b*. By providing fewer slots the panel will be stronger and less costly to manufacture.

FIGS. 9–13 show a third embodiment of an electrical connector 10*c* incorporating the concepts of the invention. Again, like reference numerals have been applied in FIGS. 9–13 corresponding to like components described above in relation to the first two embodiments shown in FIGS. 1–8.

Specifically, connector 10*c* includes a one-piece housing, generally designated 20*c*, having opposite side walls 24. Three locating flanges 34 (FIG. 10) project from one of the side walls 24 and two locating flanges 34 project from the opposite side wall 24. A pair of stop flanges 38 project from each opposite side wall 24. In connector 10*c*, the integrally molded flexible latch arm is provided in the form of a latch bar 40*c* which is integral with and extends between two of the stop flanges 38 as seen clearly in FIGS. 9 and 10. A latch projection 41 is supported on a tab 42 that extends inwardly from the center of latch bar 40*c*. The latch projection 41 projects in the insertion direction of the connector into the panel. The latch bar 40*c* is thinner than the flanges 38 to permit torsional flexing along double arrow-headed arc D about longitudinal axis E of latch bar 40*c* (FIG. 9) when the latch projection 41 abuts panel 14.

Figure 11:
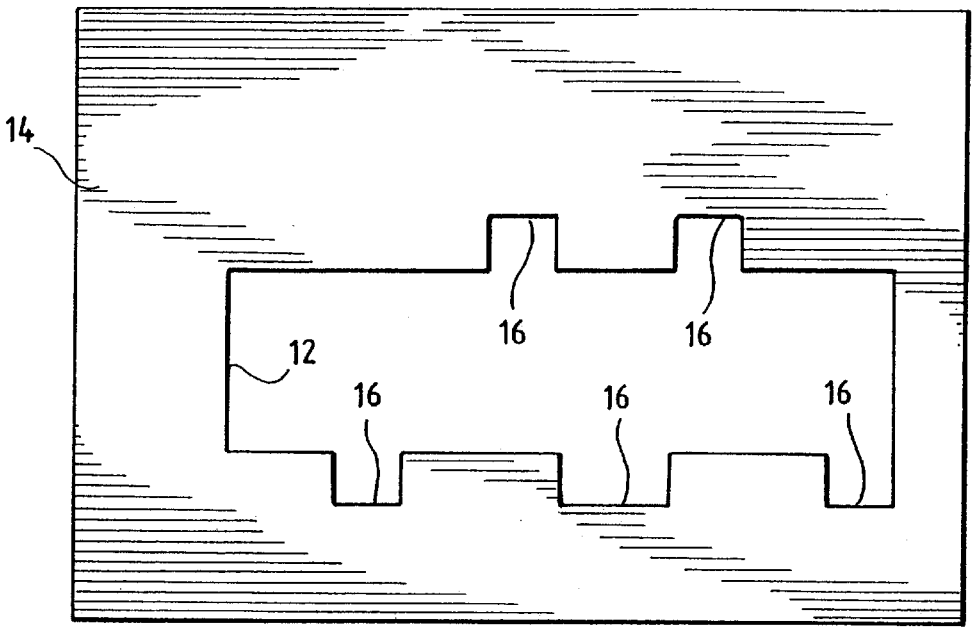
FIG. 11 is a plan view of a panel having an opening for receiving the connector of FIGS. 9 and 10.

FIG. 11 shows a panel 14 having an elongated opening 12 provided with a plurality of radially extending locating slots 16 in the sides thereof. Three locating slots are provided at one side of the opening to receive the three locating flanges 34 (FIG. 10) on one side of the connector, and two locating slots 16 are provided at the opposite side of the opening to accommodate the two locating flanges 34 (FIG. 9) on the opposite side of the connector. The asymmetrical arrangement of the locating flanges and the corresponding locating slots 16 assures correct polarization of the connector 10c to the panel 14. The connector is inserted into the opening in an insertion direction as indicated by arrows "B" in FIGS. 9 and 10. When the connector is inserted into opening 12, locating flanges 34 pass through locating slots 16 until stop flanges 38 abut against the side of the panel 14 opposite the insertion direction of the connector. When the connector reaches its inserted position, latch projection 41 will abut that opposite side of the panel and flex or "cock" by a torsional movement of the latch bar 40*c* .

Figure 12:
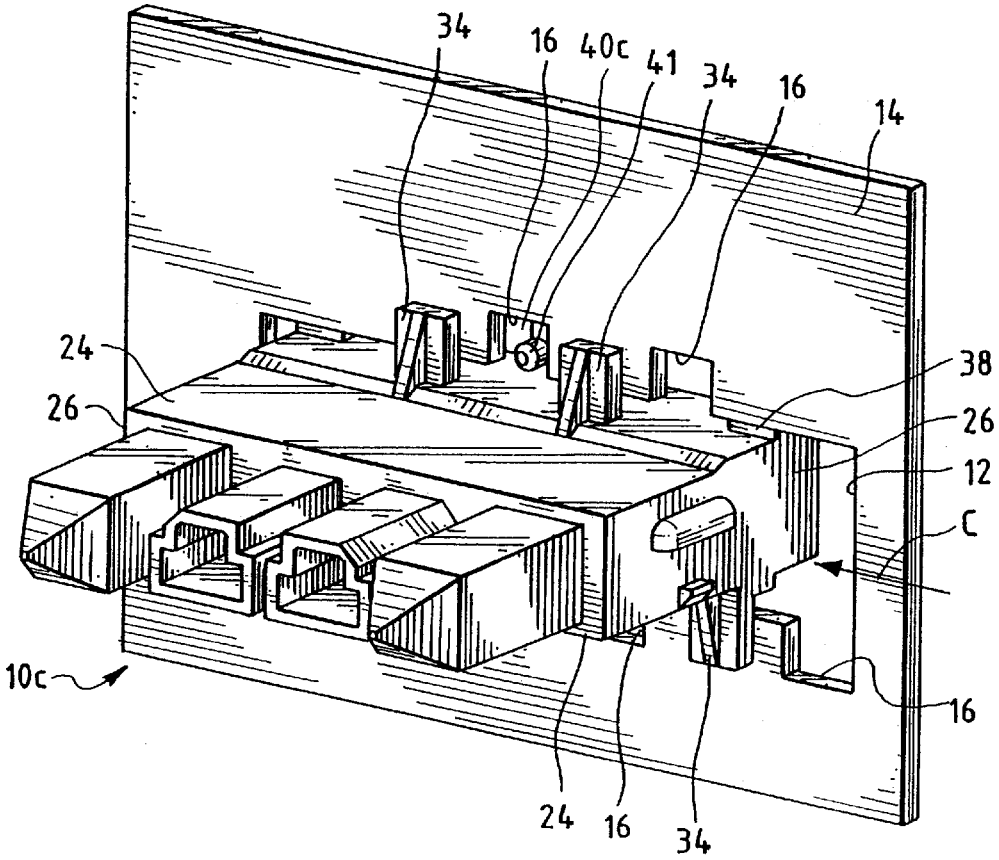
FIG. 12 is a perspective view of the connector of FIGS. 9 and 10 inserted into the opening in the panel of FIG. 11 and moved to its final latched position.
Figure 13:
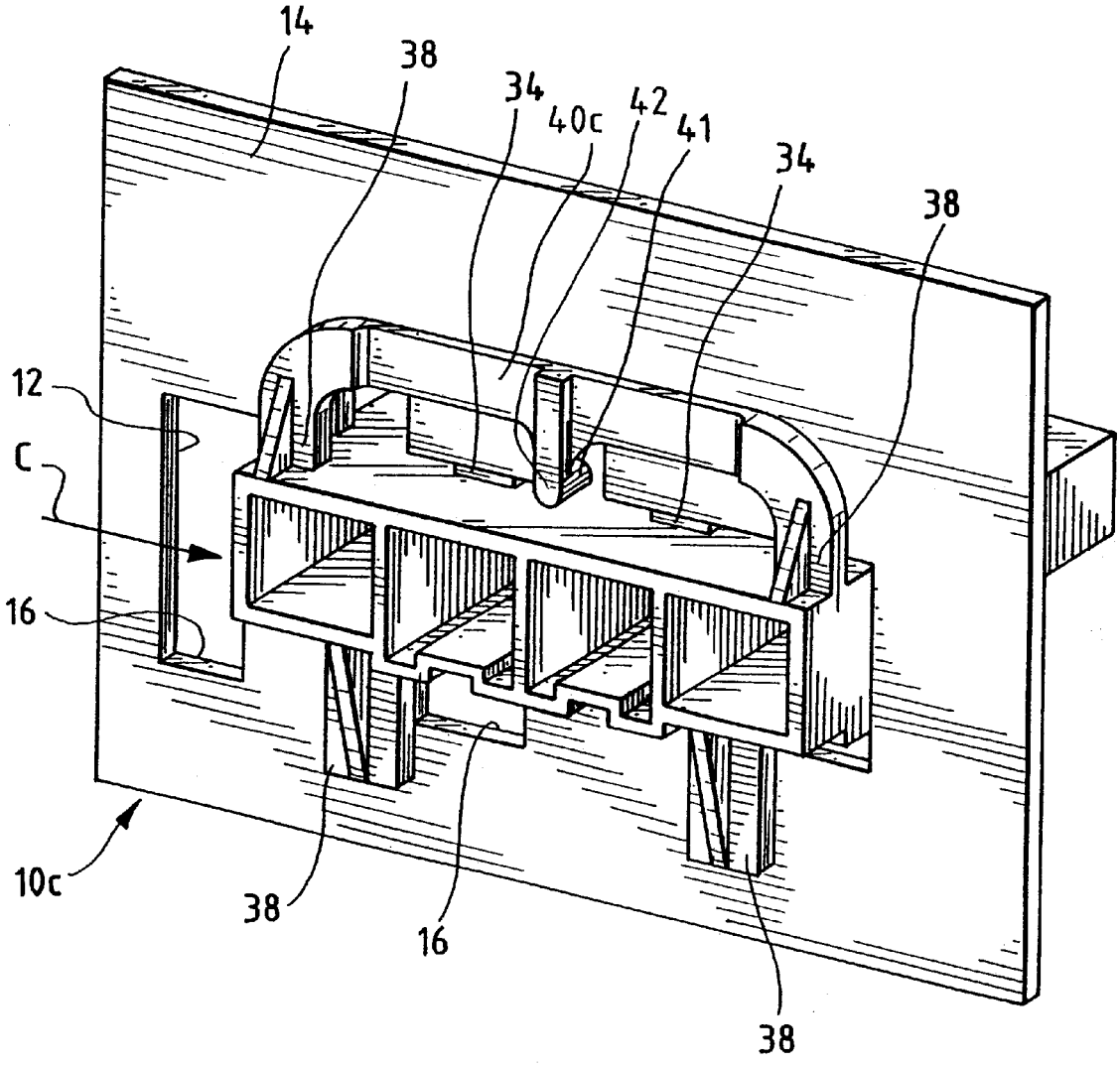
FIG. 13 is a perspective view of the assembly of FIG. 12, looking at the opposite side of the panel.

After connector 10*c* is inserted into opening 12 in a first linear direction to its inserted position, the connector then is moved in a second linear direction generally parallel to the panel as indicated by arrows "C" in FIGS. 12 and 13 to a final latched position as shown. In the final latched position, the panel is sandwiched between locating flanges 34 and stop flanges 38. In the final position, latch projection 41 snaps by torsional movement of latch bar 40*c*. into one of the locating slots 16 as best seen in FIG. 12, under the energy stored in the flexible latch bar 40*c*, to latch or lock the connector in its final position. In this embodiment latch protector 41 is smaller than location slot 16 and the outer dimensions of the side walls 24, 26 are smaller than the opening 12 in panel 14 for a blind mating application allowing for a limited amount of "floating" of the connector 10*c* in the panel opening 12. However, the panel opening 12 and the locating slot 16 can be dimensioned to ensure that connector 10*c* more tightly fits in the opening 12.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A system for mounting an electrical connector in a panel, comprising:

a panel having first and second sides and an opening having an edge with at least one locating slot extending outwardly from the opening beyond the edge;

a connector having a housing insertable in a first linear direction from the first side of the panel along an axis to an insertion position into the opening in the panel, the housing having at least one outwardly extending locating flange at one side of the housing for passing through the locating slot of the opening as the housing is inserted thereinto and at least one outwardly extending stop flange spaced axially and transversely from the locating flange at said one side of the housing for abutting the first side of the panel when the locating flange clears the second side of the panel, the housing being movable within the opening in the panel in a second linear direction generally perpendicular to said first linear direction and generally parallel to the panel from said insertion position to a latched position; and a latch arm projecting from said one side of the connector housing engageable with a latch slot extending outwardly from the opening in the panel beyond the edge of the opening when the housing is in said latched position;

wherein said locating slot comprises said latch slot.

2. The system of claim 1, including at least one said locating flange, at least one said stop flange and at least one said latch arm on each of two opposite sides of the connector housing.

3. The system of claim 1 wherein said latch arm comprises a flexible cantilevered latch arm extending generally parallel to said first linear direction.

4. The system of claim 1, including a plurality of said stop flanges at said one side of the connector housing.

5. The system of claim 1, including a plurality of said locating flanges at said one side of the connector housing for passing through a plurality of said locating slots in the opening in the panel.

6. The system of claim 5, including a plurality of said stop flanges at said one side of the connector housing.

7. A system for mounting an electrical connector in a panel, comprising:

a panel having an opening, with the opening having an edge with at least one locating slot extending outwardly from the opening beyond the edge;

a connector having a housing insertable into the opening in the panel along an axis to an insertion position, the housing having at least one outwardly extending locating flange for passing through the locating slot of the opening as the housing is inserted thereinto and at least one outwardly extending stop flange spaced axially and transversely from the locating flange for abutting the panel when the housing is in the inserted position, the housing being movable within the opening in the panel from the insertion position to a latched position; and a latch arm projecting from the connector housing and engageable with said locating slot when the housing is in said latched position to lock the housing thereat wherein said latch arm comprises a flexible cantilevered latch arm extending generally perpendicular to the insertion direction of the connector.

8. The system of claim 7 wherein said latch arm is cantilevered off of said stop flange.

9. A system for mounting an electrical connector in a panel, comprising:

a panel having first and second sides and an opening having an edge with a plurality of locating slots extending outwardly from the opening beyond the edge;

a connector having a housing insertable in a first linear direction from the first side of the panel along an axis to an insertion position into the opening in the panel, the housing having a plurality of locating flanges at one side of the housing for passing through the locating slots of the opening as the housing is inserted thereinto and a plurality of outwardly extending stop flanges spaced axially and transversely from the locating flanges at said one side of the housing for abutting the first side of the panel when the locating flanges clear the second side of the panel, the housing being movable within the opening in the panel in a second linear direction generally perpendicular to said first linear direction and generally parallel to the panel from said insertion position to a latched position; and a latch arm projecting from said one side of the connector housing engageable with one of said locating slots when the housing is in said latched position.

10. The system of claim 9 wherein said latch arm comprises a flexible cantilevered latch arm extending generally parallel to said first linear direction.

11. The system of claim 9, including a plurality of said locating flanges, a plurality of said stop flanges and one of said latch arms on each of two opposite sides of the connector housing.

12. The system of claim 9 wherein said latch arm comprises a flexible cantilevered latch arm extending generally parallel to said second linear direction.

13. The system of claim 12 wherein said latch arm is cantilevered off of one of said stop flanges.

14. The system of claim 9 wherein said latch arm comprises a flexible cantilevered latch arm extending from one of said stop flanges.

15. The system of claim 14 wherein said flexible cantilevered latch arm includes a latch projection for engagement in said one locating slot.

16. The system of claim 9 wherein said latch arm comprises a flexible latch bar extending between a pair of said stop flanges.

17. The system of claim 16 wherein said flexible latch bar includes a latch projection for engagement in said one locating slot.

18. A system for mounting an electrical connector in a panel, comprising:

a panel having first and second sides and an opening having an edge with at least one locating slot extending outwardly from the opening beyond the edge;

a connector having a housing insertable in a first linear direction from the first side of the panel along an axis to an insertion position into the opening in the panel, the housing having at least one outwardly extending locating flange at one side of the housing for passing through the locating slot of the opening as the housing is inserted thereinto and at least one outwardly extending stop flange spaced axially and transversely from the locating flange at said one side of the housing for abutting the first side of the panel when the locating flange clears the second side of the panel, the housing being movable within the opening in the panel in a second linear direction generally perpendicular to said first linear direction and generally parallel to the panel from said insertion position to a latched position; and a latch arm projecting from said one side of the connector housing engageable with a latch slot extending outwardly from the opening in the panel beyond the edge of the opening when the housing is in said latched position.

19. The system of claim 18 wherein said latch arm is cantilevered off of said stop flange.

20. A system for mounting an electrical connector in a panel, comprising:

a panel having first and second sides and an opening having an edge with at least one locating slot extending outwardly from the opening beyond the edge;

a connector having a housing insertable in a first linear direction from the first side of the panel along an axis to an insertion position into the opening in the panel, the housing having at least one outwardly extending locating flange at one side of the housing for passing through the locating slot of the opening as the housing is inserted thereinto and at least one outwardly extending stop flange spaced axially and transversely from the locating flange at said one side of the housing for abutting the first side of the panel when the locating flange clears the second side of the panel, the housing being movable within the opening in the panel in a second linear direction generally perpendicular to said first linear direction and generally parallel to the panel from said insertion position to a latched position; and a latch arm projecting from said one side of the connector housing engageable with a latch slot extending outwardly from the opening in the panel beyond the edge of the opening when the housing is in said latched position wherein said latch arm comprises a flexible cantilevered latch arm extending generally parallel to said second linear direction.

21. The system of claim 20 wherein said flexible cantilevered latch arm includes a latch projection for engagement in said latch slot.

22. A system for mounting an electrical connector in a panel, comprising:

a panel having first and second sides and an opening having an edge with at least one locating slot extending outwardly from the opening beyond the edge;

a connector having a housing insertable in a first linear direction from the first side of the panel along an axis to an insertion position into the opening in the panel, the housing having at least one outwardly extending locating flange at one side of the housing for passing through the locating slot of the opening as the housing is inserted thereinto and at least one outwardly extending stop flange spaced axially and transversely from the locating flange at said one side of the housing for abutting the first side of the panel when the locating flange clears the second side of the panel, the housing being movable within the opening in the panel in a second linear direction generally perpendicular to said first linear direction and generally parallel to the panel from said insertion position to a latched position; and a latch arm projecting from said one side of the connector housing engageable with a latch slot extending outwardly from the opening in the panel beyond the edge in the opening when the housing is in said latched position wherein the connector includes at least a pair of said stop flanges, and wherein said latch arm comprises a flexible latch bar extending between the pair of stop flanges.

23. The system of claim 22 wherein said flexible latch bar includes a latch projection for engagement in said latch slot.

24. A system for mounting an electrical connector in a panel, comprising:

a panel having an opening, with the opening having an edge with at least one locating slot extending outwardly from the opening beyond the edge;

a connector having a housing insertable into the opening in the panel along an axis to an insertion position, the housing having at least one outwardly extending locating flange for passing through the locating slot of the opening as the housing is inserted thereinto and at least one outwardly extending stop flange spaced axially and transversely from the locating flange for abutting the panel when the housing is in the inserted position, the housing being movable within the opening in the panel from the insertion position to a latched position; and a latch arm projecting from the connector housing and engageable with said locating slot when the housing is in said latched position to lock the housing thereat wherein said latch arm comprises a flexible cantilevered latch arm extending from said stop flange.

25. The system of claim 24 wherein said flexible cantilevered latch arm includes a latch projection engageable in said locating slot.

* * * * *